US007397333B2

(12) United States Patent
Fleege

(10) Patent No.: US 7,397,333 B2
(45) Date of Patent: Jul. 8, 2008

(54) TRIP UNIT HAVING BIMETAL ELEMENT LOCATED OUTSIDE THE YOKE

(75) Inventor: Dennis William Fleege, Cedar Rapids, IA (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 11/583,653

(22) Filed: Oct. 18, 2006

(65) Prior Publication Data

US 2008/0094155 A1 Apr. 24, 2008

(51) Int. Cl.
*H01H 75/12* (2006.01)
*H01H 77/00* (2006.01)
*H01H 81/00* (2006.01)
*H01H 83/00* (2006.01)

(52) U.S. Cl. ..... 335/35; 335/6

(58) Field of Classification Search ..... 335/6
See application file for complete search history.

(56) References Cited

U.S. PATENT DOCUMENTS 2,618,716 A * 11/1952 Boller et al. ..... 335/6
3,317,867 A * 5/1967 Powell ..... 335/37
3,745,414 A * 7/1973 Frantti et al. ..... 361/46
3,760,308 A * 9/1973 Misencik et al. ..... 335/35
4,080,582 A * 3/1978 Link ..... 335/37
4,232,282 A * 11/1980 Menocal ..... 335/202
4,513,268 A * 4/1985 Seymour et al. ..... 335/35
4,604,596 A * 8/1986 Yokoyama et al. ..... 335/14
4,616,200 A * 10/1986 Fixemer et al. ..... 335/35
4,713,640 A * 12/1987 Murphy et al. ..... 335/194
4,897,625 A * 1/1990 Yokoyama et al. ..... 335/14
5,151,671 A * 9/1992 Hirao et al. ..... 335/172
5,173,674 A * 12/1992 Pannenborg et al. ..... 335/35
5,182,532 A * 1/1993 Klein ..... 335/35
5,245,302 A * 9/1993 Brune et al. ..... 335/35
5,250,918 A * 10/1993 Edds et al. ..... 335/35
5,302,787 A 4/1994 Edds et al. ..... 200/401
5,373,272 A 12/1994 Scheel et al. ..... 335/16
5,381,120 A * 1/1995 Arnold et al. ..... 335/35
5,510,759 A * 4/1996 Gula et al. ..... 335/18
5,694,101 A * 12/1997 Lavelle et al. ..... 335/172
5,821,839 A * 10/1998 Heise et al. ..... 335/35
5,825,598 A * 10/1998 Dickens et al. ..... 361/42
5,831,509 A * 11/1998 Elms et al. ..... 337/333
5,864,266 A 1/1999 Mickelson et al. ..... 335/35
5,870,008 A * 2/1999 Pannenborg et al. ..... 335/35
6,232,860 B1 * 5/2001 Acevedo et al. ..... 335/167

(Continued)

*Primary Examiner*—Lincoln Donovan
*Assistant Examiner*—Mohamad A Musleh

(57) ABSTRACT

A trip unit in a miniature circuit breaker includes a magnetic yoke and a bimetal mounted on the outside of the yoke. The bimetal is welded at one end to a load terminal that leads to a terminal connector and at the other end to a pigtail. The pigtail, instead of the bimetal, passes through the yoke for connection to the blade of the circuit breaker. To induce a higher magnetic field for faster tripping, a second pigtail may be passed through the yoke in which one end of the second pigtail is connected to the load terminal near the terminal connector and the other end is connected to the bimetal near the load terminal connection point. The load terminal may include at least two parts, one part including the adjustment screw and the other part including the terminal screw. These parts may be separated by air or an insulator.

21 Claims, 5 Drawing Sheets

U.S. PATENT DOCUMENTS 6,239,676 B1 * 5/2001 Maloney et al. ..... 335/6
6,489,867 B1 * 12/2002 Turner et al. ..... 335/6
6,591,482 B1 7/2003 Fleege et al. ..... 29/605
6,801,110 B2 * 10/2004 Kolberg et al. ..... 335/35
2004/0196123 A1 * 10/2004 Simms et al. ..... 335/6
2006/0028307 A1 * 2/2006 McCoy et al. ..... 335/172

* cited by examiner

TRIP UNIT HAVING BIMETAL ELEMENT LOCATED OUTSIDE THE YOKE

FIELD OF THE INVENTION

This invention is directed generally to a trip unit, and, more particularly, to a trip unit having a bimetal element located outside the yoke.

BACKGROUND OF THE INVENTION

Circuit breakers provide automatic current interruption to a monitored circuit when undersired overcurrent conditions occur. These overcurrent conditions include, for example, arc faults, overloads, ground faults, and short-circuits. In a thermal magnetic circuit breaker, an overcurrent is detected when the fault current generates sufficient heat in a strip composed of a resistive element or bimetal to cause it to deflect. The mechanical deflection triggers a trip assembly that includes a spring-biased latch mechanism to force a movable contact attached to a movable blade away from a stationary contact, thereby breaking the circuit. When the circuit is exposed to a current above that level for a predetermined period of time, the trip assembly activates and tripping occurs thereby opening the circuit.

The bimetal deflects in a predictable and repeatable manner across a thermal profile over a period of time, and the rate and extent of deflection is a function of various parameters, including the cross-sectional area (width, thickness), length, and composition of the bimetal element. The bimetal is attached to a yoke that is magnetically coupled to a movable armature. The movement of the bimetal in response to excessive electrical current causes the armature to move relative to the yoke, triggering a chain of mechanical actions that cause the breaker to thermally trip. For magnetic tripping in response to sudden overloads, a magnetic field induced relative to the magnetic yoke causes the armature to be moved relative to the yoke, triggering a magnetic trip.

In miniature circuit breakers, such as the QO® and Homeline® family of circuit breakers available from Square D Company, the width of the bimetal (typically ¼ inch) is limited by the width of the housing (typically ¾ to 1 inch). To decrease the width of the overall miniature circuit breaker, such as in half-size or tandem circuit breakers, the width of the bimetal would have to be decreased as well, but at the expense of the trip ratings for the circuit breaker. Alternately, the thickness of the bimetal would have to be increased in order to maintain the same cross-sectional area, but increasing thickness substantially reduces bimetal flexibility and renders thermal tripping and calibration very difficult if not impossible. Bimetals must maintain a minimum cross-sectional area for a desired $I^2t$ (current squared time) capacity in order to be flexible enough to move a given distance when heated. It is desirable to decrease the width of a miniature circuit breaker without encountering these difficulties.

Existing thermal circuit breakers utilize a bimetal that is either received inside a yoke or in line with a yoke. In the former implementations, the width of the bimetal is constrained by the width of the yoke, so a decrease in the width of the circuit breaker results in a reduction in yoke width, which in turn reduces the bimetal width, requiring an increase in its thickness in order to maintain the same $I^2t$ value. In the latter implementations, both the width and the length of the bimetal is constrained by the form factor of the circuit breaker. A shorter bimetal is used because it is in line with the yoke. The shorter length reduces the overall effective travel distance of the bimetal so as its width is reduced, its flexibility is significantly reduced by any increase in thickness if the $I^2t$ capacity is to be unchanged. It is desirable to decrease the width of a miniature circuit breaker without encountering these difficulties.

Thus, a need exists for an improved apparatus and method. The present invention is directed to satisfying one or more of these needs and to solving other problems.

SUMMARY OF THE INVENTION

In an embodiment of the present invention, a trip unit for use in a circuit breaker includes a magnetic yoke, a pigtail conductor, a bimetal, and a load terminal. The magnetic yoke includes a shaped portion defining a channel. A portion of the pigtail conductor is received in the channel, and the pigtail conductor is attached to a conductive blade of the circuit breaker. The bimetal is mounted to an exterior surface of the shaped portion outside of the channel. The load terminal is attached to one end of the bimetal, and the other end of the bimetal is attached to the pigtail conductor. According to an aspect, the trip unit further includes a second pigtail conductor attached at one end to the bimetal proximate the load terminal and at the other end to a portion of the load terminal proximate a terminal connection. A portion of the second pigtail is also received in the yoke. The load terminal may be composed of a low conductivity material or may include a first part including a calibration screw and a physically separate second part that includes the terminal connection. The bimetal is attached to the first part, and the second pigtail conductor is attached to said second part. The first part and the second part may be separated by an insulator or by air.

In some aspects, the trip unit has a width no greater than three-quarters of one inch or three-eighths of one inch. In other aspects, the length of the bimetal is longer than the yoke. The other end of the bimetal may be attached to the pigtail conductor by a weld. In still other aspects, the shaped portion of the yoke channel may be generally U- or L-shaped.

In another embodiment of the present invention, a trip unit for a miniature circuit breaker includes a magnetic yoke, a conductive blade, a load terminal, a bimetal, and a flexible conductor. The magnetic yoke has a shaped portion forming a channel. The conductive blade is coupled to movable contacts in the circuit breaker. The load terminal has an end part that includes a terminal connector. The bimetal is attached at one end to the load terminal of the circuit breaker and at another end to an exterior surface of the shaped portion. The flexible conductor is attached to the conductive blade and to the bimetal. A portion of the flexible conductor passes through the channel opposite the bimetal.

In an aspect, the flexible conductor is attached to the bimetal by a weld, whereby electrical current will flow from the conductive blade directly to the bimetal via the flexible conductor. The trip unit may further include a second flexible conductor connected at one end to the bimetal proximate the load terminal and at an other end to the end part proximate the terminal connector. A portion of the second flexible conductor also passes through the channel of the magnetic yoke. The flexible conductors induce a magnetic field relative to the yoke for causing mechanical displacement of an armature coupled to the yoke in response to electrical current passing through the flexible conductors.

In other aspects, the trip unit further includes a second flexible conductor connected at one end to the bimetal proximate the load terminal and at an other end to the end part proximate the terminal connector. A portion of the second flexible conductor also passes through the channel of the magnetic yoke, the flexible conductors inducing a magnetic field relative to the yoke for causing mechanical displacement of an armature coupled to the yoke in response to electrical current passing through the flexible conductors.

In another aspect, the second flexible conductor is connected to the bimetal so as to form a loop before the second flexible conductor enters the yoke. The yoke may include a retaining member for holding the flexible conductor and the second flexible conductor within the yoke.

In still further aspects, the trip unit may have an overall width no greater than one inch. The length of the bimetal is greater than 1.5 inches. Its width may not exceed one-quarter inch. The shaped portion of the yoke may be generally U-shaped in some aspects.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings, in which.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to include all alternatives, modifications and equivalent arrangements as may be included within the spirit and scope of the invention as defined by the appended claims.

Figure 1:
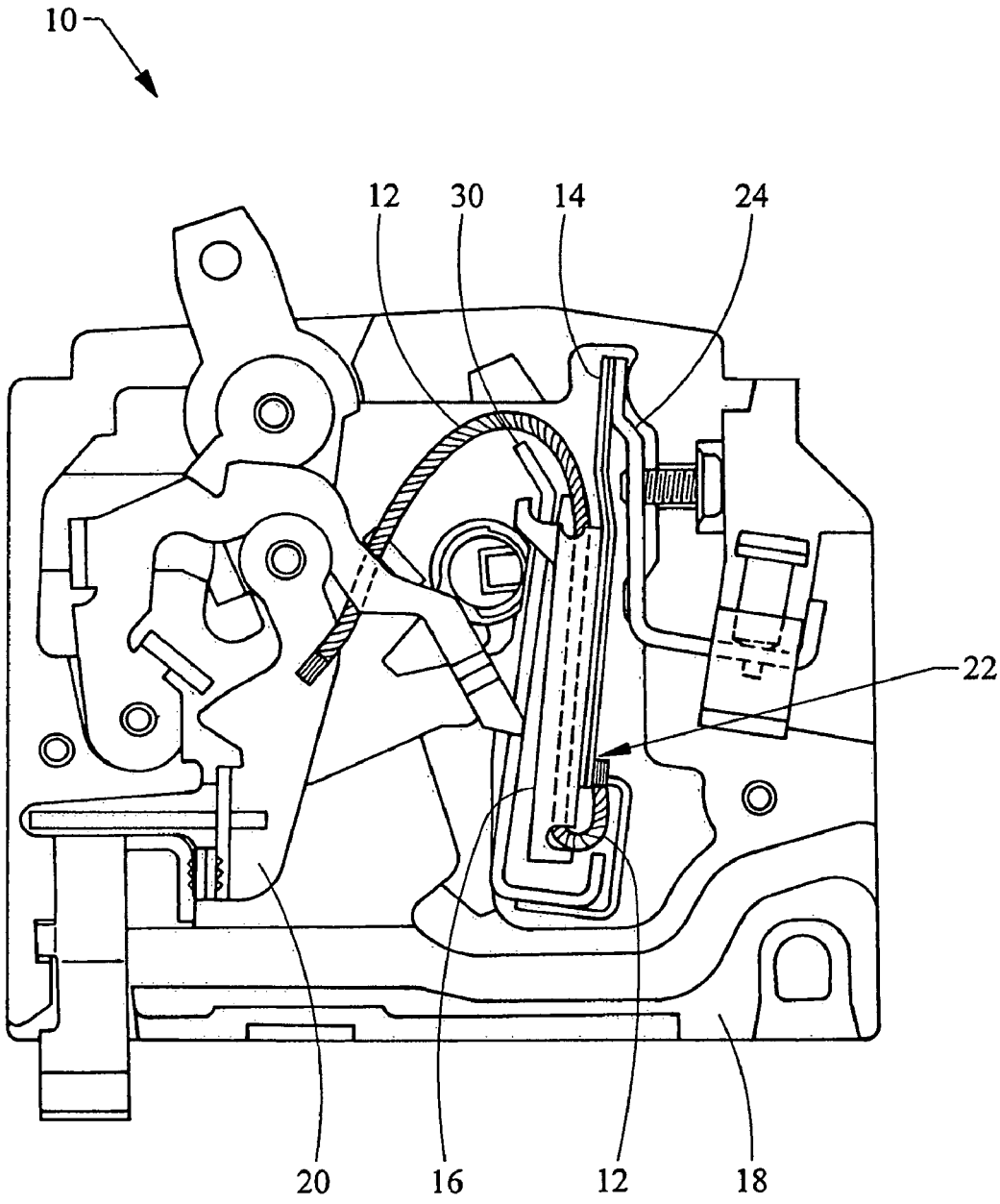
FIG. 1 is a side view of a circuit breaker having a bimetal that is attached to the outside of a yoke while a pigtail conductor passes through the inside according to an aspect of the present invention.

Referring now to the drawings and initially to FIG. 1, a circuit breaker 10 includes a flexible pigtail conductor 12, a bimetal 14, a magnetic yoke 16, a housing 18, and a conductive blade 20. For ease of illustration, some circuit breaker components are omitted, however, these components, which may be found in the QO® or Homeline® miniature circuit breakers available from Square D Company, are not necessary for an understanding of the aspects of the present invention. One end of the bimetal 14 is welded to a load terminal 24, and the other end is attached to the pigtail conductor 12 by a weld 22. Passing through the yoke 16 is part the pigtail conductor 12, instead of a bimetal 84 as occurs in existing circuit breakers (see FIG. 2). The pigtail conductor 12 carries electrical current from the conductive blade 20 directly to the bimetal 14. A movable magnetic armature 30 is pivotally supported on the magnetic yoke 16 by a hook or rocker and a pivot tab formed on the armature 30.

The bimetal 14 is mounted to the outermost surface of the yoke 16 such that the bimetal 14 is in a parallel relationship relative to the outside of the yoke 16. In other words, the bimetal 14 is mounted on the outside of the yoke such that the exterior planar surfaces of the bimetal 14 and the yoke 16 are adjacent to one another. The bimetal 14 is longer than the yoke 16 and extends along the length of the yoke 16 and beyond it. The bimetal 14 is positioned in a generally parallel relationship with the pigtail conductor 12 as it passes through the yoke 16. According to aspects of the present invention, the yoke includes a portion that is generally U-shaped, forming a U-shaped channel that receives a pigtail conductor. The ends of the U-shaped portion of the yoke forms two pole faces. According to other aspects of the present invention, the yoke includes a portion that is generally L-shaped, and the corresponding armature is also L-shaped. The end of the L-shaped portion of the yoke forms a single pole face.

The circuit breaker 10 is of the miniature type, which has an amperage rating of 10 A to 150 A. In various aspects, the width of the circuit breaker 10 may be one inch, ¾ inch, ½ inch, ⅜ inch, or less than ⅜ inch. Preferably, the length of the bimetal 14 exceeds that of the yoke 16, and the bimetal 14 extends along at least the entire length of the yoke 16. The length of the bimetals according to specific aspects of the present invention is about one and three-eighths of an inch. The width of the bimetals according to specific aspects of the present invention is about one eighth to about one quarter of one inch.

By mounting the bimetal 14 outside of the yoke 16, aspects of the present invention advantageously allow the overall width of the circuit breaker to be reduced without having to decrease the width or increase the thickness of the bimetal to attain a desired $I^2t$ performance. Any increase in the thickness in the bimetal will decrease its flexibility. Wider bimetals yield more consistent deflection movements and better force relationships among the tripping elements compared to narrower ones. The dimensions (width, thickness, length) of the bimetal 14 are optimized for both magnetic and thermal trip performance without altering the shape of the magnetic yoke size with the exception of its width. Indeed, if the circuit breaker width decreases, the width of the bimetal 14 does not need not be decreased and even its length can be increased, because there is more space available outside the yoke 16. In existing circuit breakers, the maximum width of the bimetal was constrained by the interior width of the yoke in which the bimetal was received. Increasing the bimetal length increases its overall effective travel distance, causing more rapid tripping. As the form factor of the circuit breaker decreases, there is less space to accommodate the components of the trip mechanism.

Another advantage to aspects of the present invention is that the current rating of the circuit breaker can be increased when a larger bimetal is installed outside of the yoke. The $I^2t$ capacity of the circuit breaker increases commensurate with the increase in the bimetal, resulting in a higher overall current rating.

Aspects of the present invention also advantageously allow the circuit breaker to meet a required $I^2t$ (current squared time) thermal capacity without having to sacrifice the cross-sectional area of the bimetal. Miniature circuit breakers in accordance with the present invention have performance and capacity characteristics that approach those of full-size circuit breakers. Additionally, mounting of the bimetal outside of the yoke provides more flexibility for optimizing the dimensions of the bimetal without being constrained by width and/or length dimensions of the circuit breaker in existing implementations.

Figure 2:
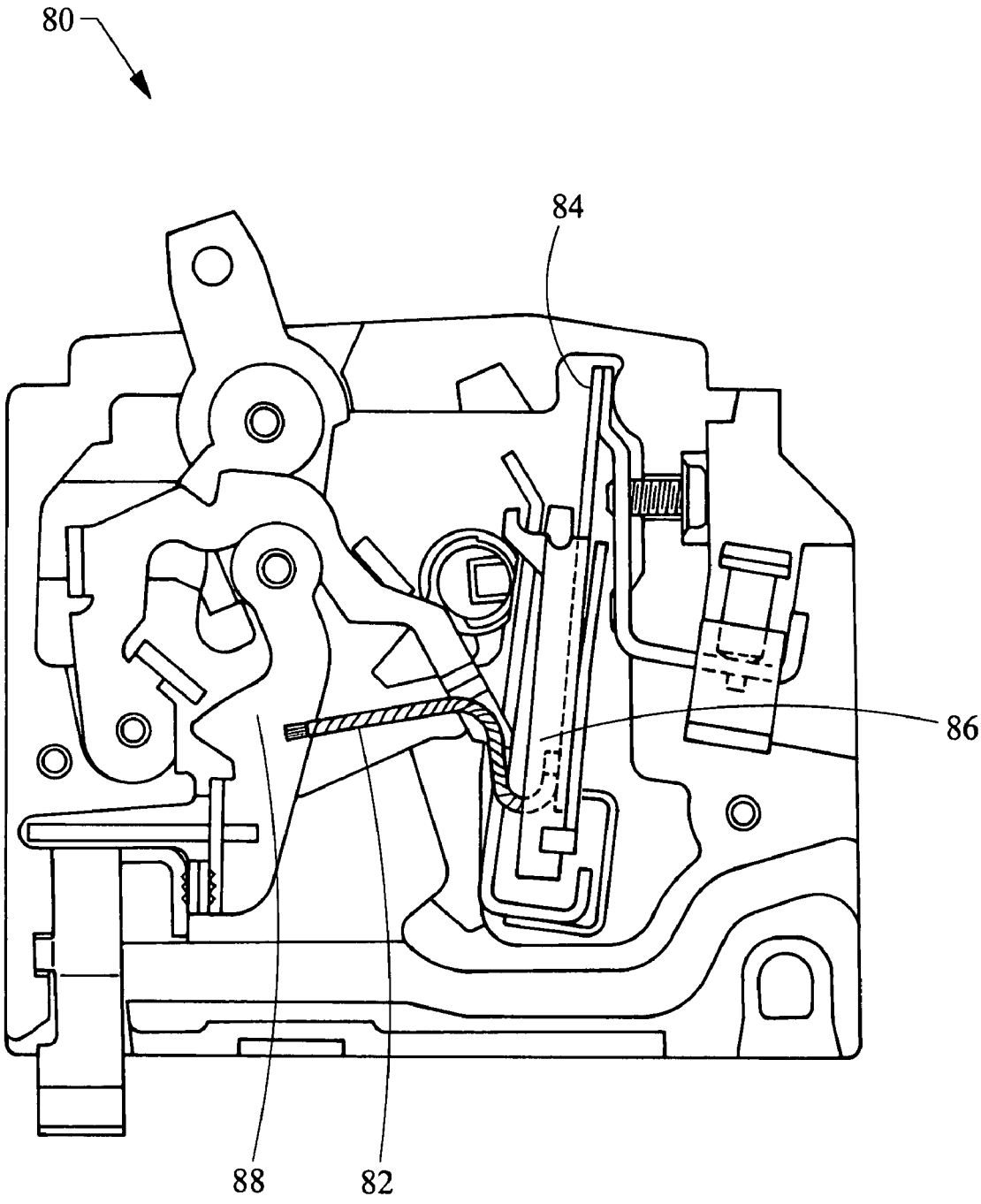
Fig. 2 (Prior Art)
FIG. 2 is a side view of a prior-art circuit breaker having a bimetal attached inside a yoke rather than outside and a pigtail conductor passing around the bottom of the yoke.

FIG. 2 is a side view of a prior-art circuit breaker 80 having a yoke 86 that receives a bimetal 84 therein. A pigtail conductor 82 is attached between a conductive blade 88 of the circuit breaker and the bimetal 84 inside the yoke 86. Here, as the width of the circuit breaker decreases, so too must the width of the bimetal 84. To maintain the same bimetal cross-sectional area so that the breaker's $I^2t$ specification is preserved, the bimetal's thickness would have to be increased proportionate to the decrease in its width, reducing its flexibility to move a desired distance as it is heated.

By contrast, by mounting the bimetal outside of the yoke, aspects of the present invention do not suffer from the challenges faced by the prior-art arrangements where the circuit breaker's width is to be reduced. As compared to implementations where the bimetal is received inside the yoke, aspects of the present invention can easily maintain the same bimetal width even as the circuit breaker's width is reduced. Optimization of the bimetal's width, length, and thickness for both magnetic and thermal trip requirements is significantly improved according to aspects of the present invention.

Figure 3:
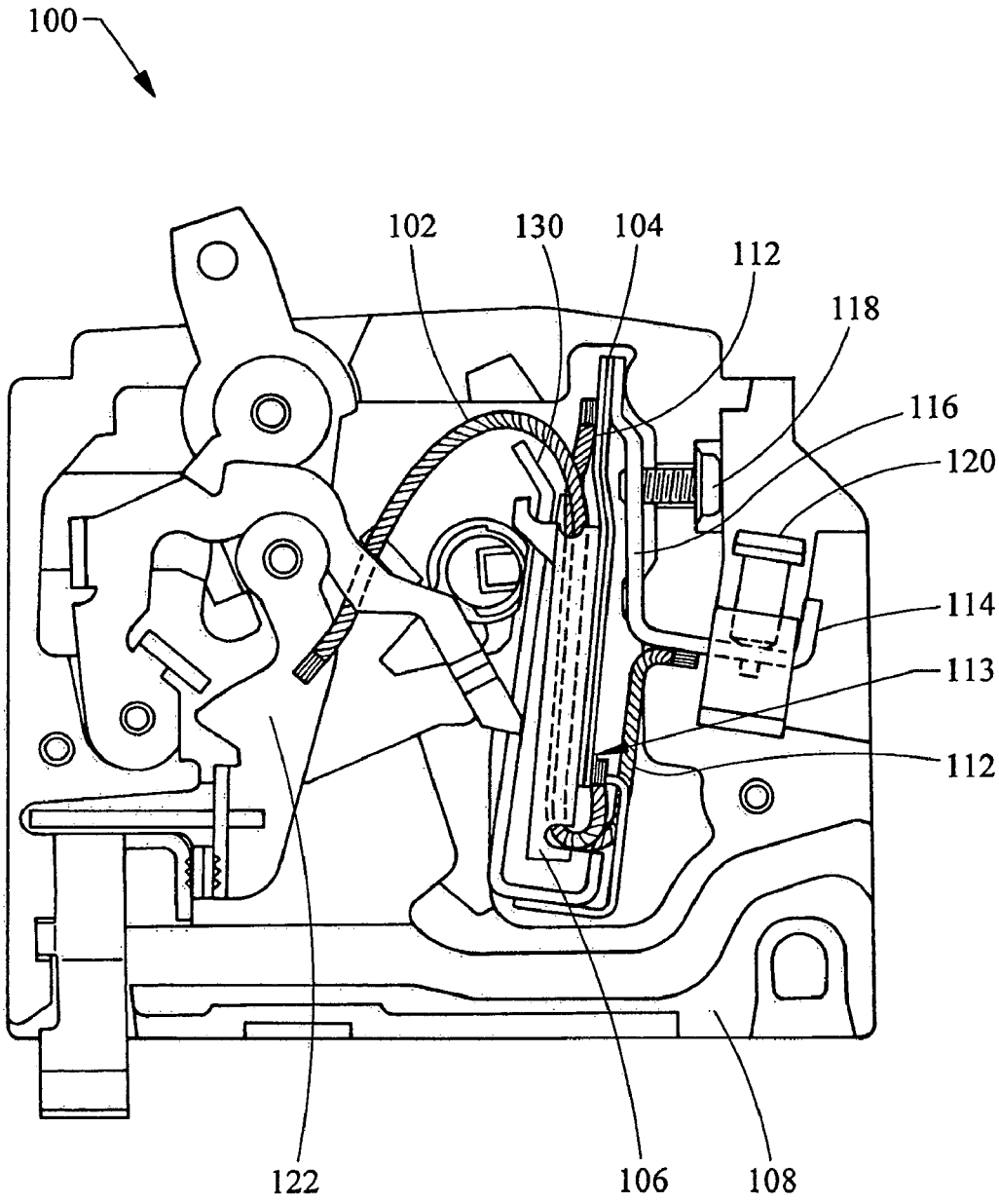
FIG. 3 is a side view of a circuit breaker having a second pigtail conductor passing through the inside of the yoke for enhanced magnetic tripping and attached between the bimetal and load terminal according to an aspect of the present invention.

For higher induced magnetic fields, it is known to wind the pigtail conductor around the magnetic yoke a number of turns commensurate with the desired increase in magnetic field. However, because the bimetal according to aspects of the present invention is mounted to the exterior of the yoke where the pigtail winding would otherwise be located, a different solution for achieving a higher magnetic field is needed. FIG. 3 illustrates a circuit breaker 100 where an increased magnetic field is induced in a yoke 106 relative to the implementation of FIG. 1 by passing a second pigtail conductor 112 through the yoke 106. As with the implementation shown in FIG. 1, a pigtail conductor 102 is attached to a conductive blade 122 at one end, passes through the yoke 106, and is attached to the bimetal 104 at the other end by a weld 113. The second pigtail conductor 112 is also passed through the yoke 106 and attached at one end to the bimetal 104 near its attachment to a load terminal 116. The other end of the second pigtail conductor 112 is attached to a field connection end 114 of the load terminal 116 near a terminal screw 120 that serves as a connection for a load conductor. The presence of two pigtail conductors 102, 112 through the yoke 106 induces a higher magnetic field to achieve more rapid tripping. The load terminal 116 is made of a low conductivity (high resistivity) material to avoid shorting and can be used as a shunt path during short circuits.

Figure 4:
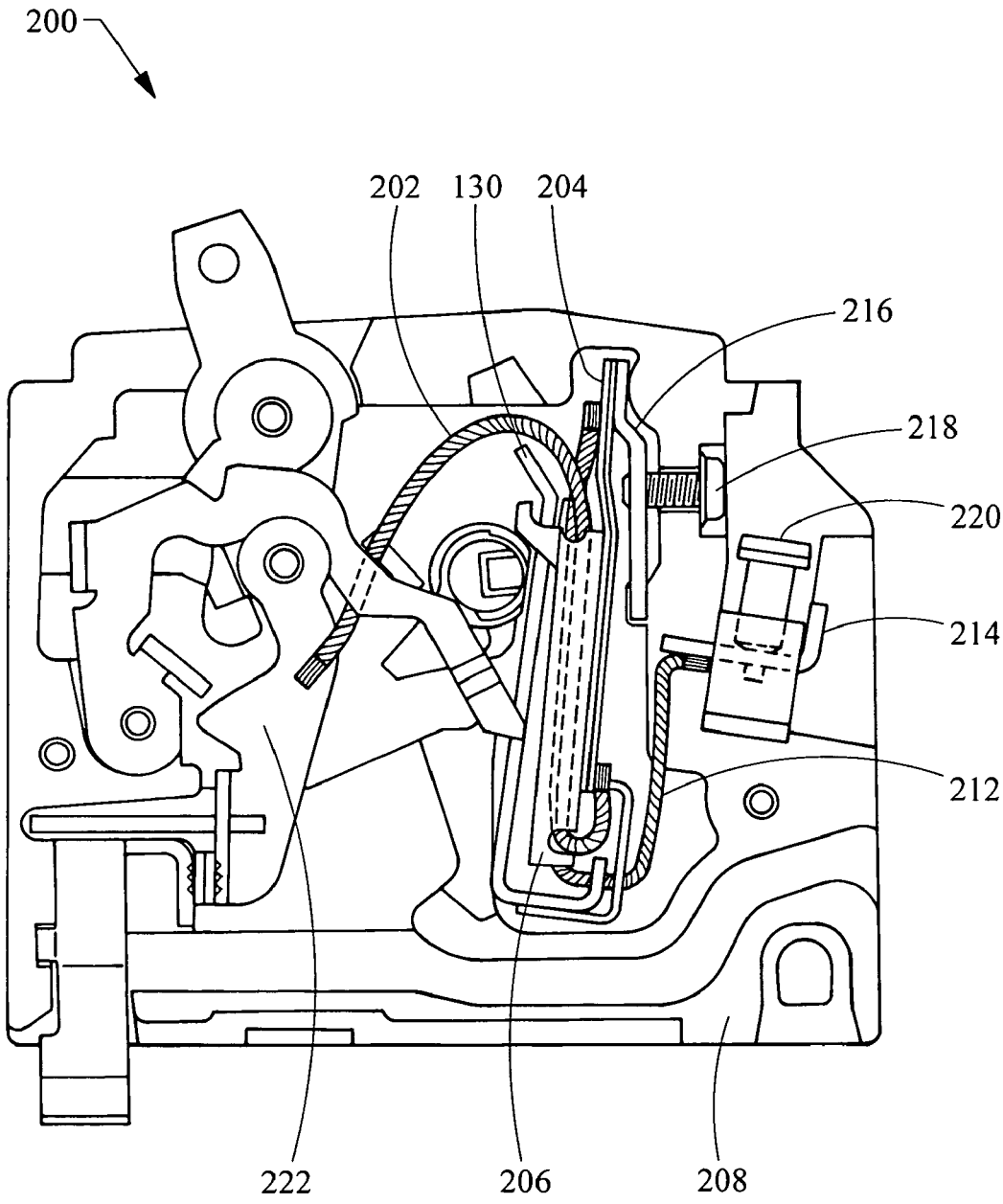
FIG. 4 is a side view of a circuit breaker similar to that shown in FIG. 3, except that the load terminal is composed of two parts to avoid shorting according to an aspect of the present invention.

A similar arrangement to FIG. 3 is shown in FIG. 4, except that the load terminal is composed of two parts separated by air or insulation to avoid shorting. In this arrangement, the load terminal need not be composed of a low conductivity material. A circuit breaker 200 includes a pigtail conductor 202 and a second pigtail conductor 212 that are passed through a yoke 206. The pigtail conductor 202 is attached between a conductive blade 222 and the lower part of a bimetal 204 once the pigtail conductor 202 exits the yoke 206. The second pigtail conductor 212 is attached at one end to the upper part of the bimetal 204 near its attachment to a load terminal 216. The load terminal 216 includes a first part 216 that includes a calibration screw 218 and a second part 214 where the field connection is made via a terminal screw 220. The other end of the second pigtail conductor 212 after it exits the yoke 206 is attached to the second part 214 near the terminal screw 220. The first part 216 and the second part 214 are physically separated at a distance by air or an insulator. A magnetic armature 130 is pivotally supported by the yoke 206.

Figure 5C:
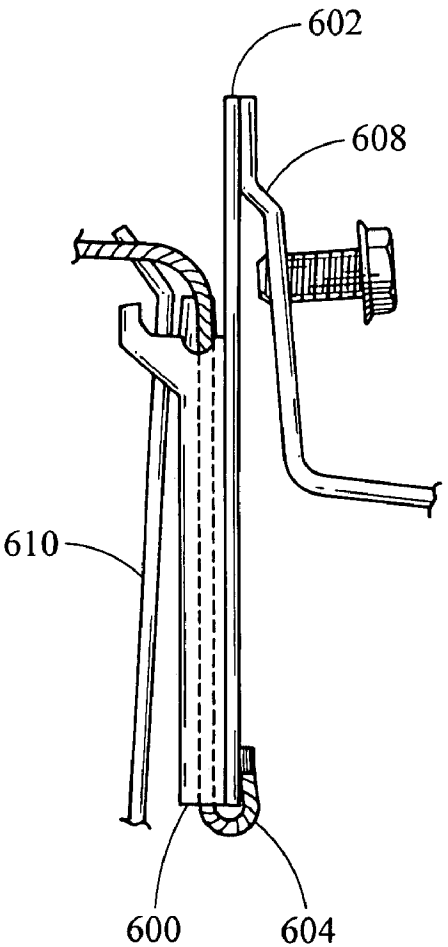
FIG. 5*c* is a side view of a bimetal attached to the outside of a yoke through which one pigtail conductor is received according to an aspect of the present invention.
Figure 5B:
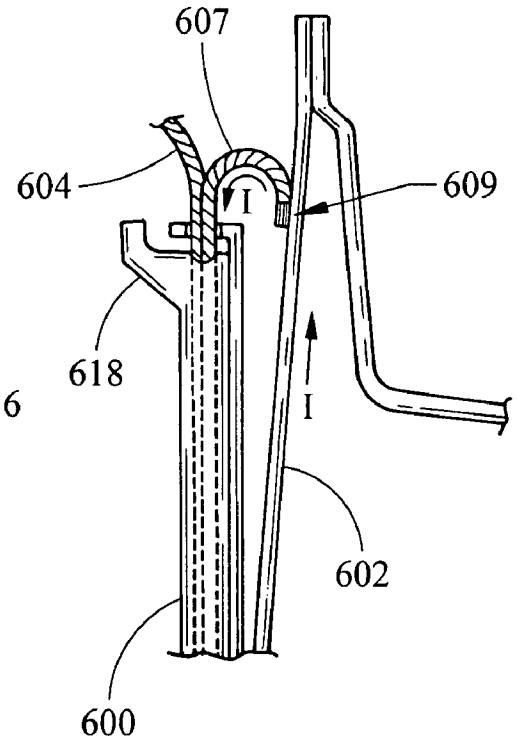
FIG. 5*b* is a side view of a retaining member in the yoke for securing the two pigtail conductors during a short circuit according to an aspect of the present invention.
Figure 5A:
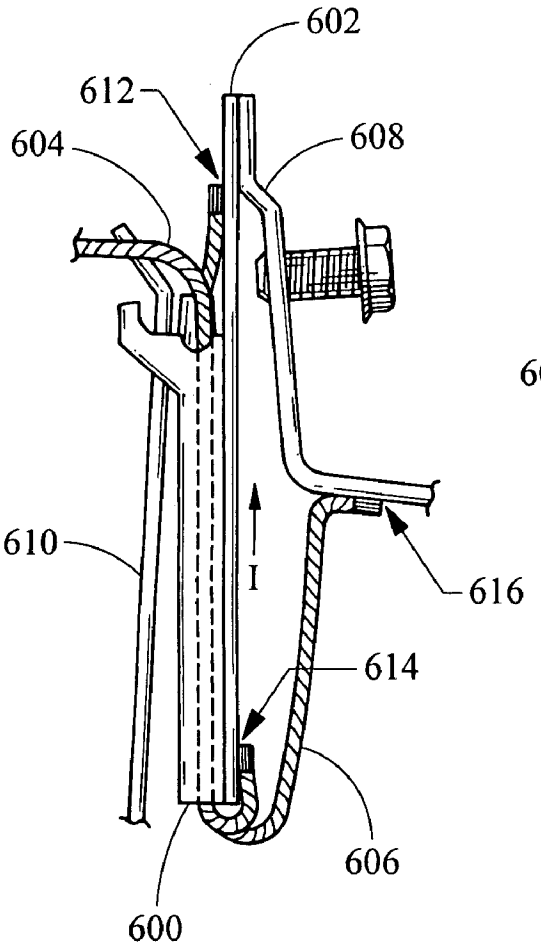
FIG. 5*a* is a side view of a bimetal attached to the outside of a yoke through which two pigtail conductors are received according to an aspect of the present invention.

FIGS. 5*a*-5*c* are side views of yoke and bimetal arrangements according to various aspects of the present invention. In FIG. 5*a*, the arrangement includes a yoke 600, a bimetal 602, a pigtail conductor 604, a second pigtail conductor 606, a load terminal 608, and an armature 610. One end of the bimetal 602 is attached to the yoke 600 at a weld at the free end 614 of the bimetal 602. The other side of the bimetal 602 is welded to one end of the first pigtail conductor 604. The first end of the pigtail conductor 606 is attached to the load terminal 608 at weld 616. The other end of the bimetal 602 is attached to the load terminal 608 on one side and on the other side to the pigtail conductor 606 at weld 612. The pigtail conductor 604 and the second pigtail conductor 606 pass through the yoke 600, inducing a higher magnetic field than if just one pigtail conductor were passed through the yoke 600. This arrangement will cause more rapid tripping compared to single-conductor arrangements. The arrangement shown in FIG. 5*a* can be used in the embodiments illustrated in FIG. 3, for example.

FIG. 5*b* illustrates a different way of attaching a second pigtail conductor 607 to the bimetal 602. The second pigtail conductor 607 is attached to the bimetal 602 in the manner shown to form a loop 609 before the second pigtail conductor 607 enters the yoke 600. The loop 609 forms a smoother transitional path for the current passing through the bimetal 602 as it transitions to the second pigtail conductor 607, helping to prevent the blow-apart effect caused by currents in the pigtail conductors 604, 607 on the hand and opposite-running currents in the bimetal 602 on the other hand. The opposite-running current in the bimetal 602 tends to direct the pigtail conductors 604, 607 away from the bimetal 602. A retaining member 618 holds the pigtail conductors 604, 607 in place relative to the yoke 600 during overcurrents, and prevents them from being blown away from the bimetal 602 due to the opposite-running current in the bimetal 602. By comparison, in FIG. 5*a*, during a sudden overcurrent, excessive current traveling up the bimetal 602 will have to make an abrupt transition and reverse its direction when it encounters the second pigtail conductor 606.

FIG. 5*c* illustrates an arrangement in which one pigtail conductor 604 is passed through the yoke 600, like that shown in FIG. 1. Compared to the arrangement shown in FIG. 5*b*, this arrangement will not magnetically trip as quickly as when multiple conductors are present inside the yoke 600 such as is the case in FIGS. 5*a* and 5*b*.

Additional aspects to the present invention relate to the methods by which the pigtail conductor(s) are assembled with the circuit breaker. In FIG. 1 (and FIG. 5*c*), the pigtail conductor 12 is attached to the conductive blade 20 and then fed downward through the yoke 16. When the pigtail conductor 12 exits the bottom of the yoke 16, the pigtail conductor 12 is looped around the end of the bimetal 14 and attached to the bottom of the bimetal 14. By contrast, in prior-art circuit breakers such as the one shown in FIG. 2, the pigtail conductor 82 is fed around the bottom of the yoke 86 before being attached to the bimetal 84. In FIG. 3 (and FIG. 5*a*), to attach the second pigtail conductor 112, it is first attached to the top of the bimetal 104 near the load terminal 116 and then fed downward through the yoke 106 where it exits the bottom of the yoke 106, where it is turned upward to be welded to the field connection end 114 of the load terminal 116.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A trip unit for use in a circuit breaker, comprising:

a magnetic yoke having a shaped portion defining a channel, said shaped portion having an inner surface facing an armature of said trip unit and having an exterior surface opposite said inner surface and facing away from said armature of said trip unit;

a pigtail conductor, a portion of which is received in said channel, attached to a conductive blade of said circuit breaker;

a bimetal mounted to at least a portion of said exterior surface such that said bimetal extends along the length of said exterior surface, said bimetal having a length that is longer than said shaped portion; and a load terminal attached to one end of said bimetal, said bimetal being attached to said pigtail conductor.

2. The trip unit of claim 1, further comprising a second pigtail conductor attached at one end to said bimetal proximate said load terminal and at the other end to a portion of said load terminal proximate a terminal connection, a portion of said second pigtail also being received in said yoke.

3. The trip unit of claim 2, wherein said load terminal includes a first part including a calibration screw and a physically separate second part that includes said terminal connection, said bimetal being attached to said first part and said second pigtail conductor being attached to said second part.

4. The trip unit of claim 3, wherein said first part and said second part are separated by an insulator.

5. The trip unit of claim 3, wherein said first part and said second part are separated by air.

6. The trip unit of claim 1, wherein said trip unit has a width no greater than three-quarters of one inch.

7. The trip unit of claim 1, wherein said trip unit has a width no greater than three-eighths of one inch.

8. The trip unit of claim 1, wherein said load terminal is composed of a material having a low conductivity.

9. The trip unit of claim 1, wherein said shaped portion defining said channel of said magnetic yoke is generally U-shaped.

10. The trip unit of claim 1, wherein said shaped portion defining said channel of said magnetic yoke is generally L-shaped.

11. The trip unit of claim 2, wherein said bimetal is attached to said pigtail conductor by a weld.

12. The trip unit of claim 1, wherein the length of said bimetal is longer than said yoke.

13. A trip unit for a miniature circuit breaker, comprising:

a magnetic yoke having an inner surface facing an armature of said trip unit and having an exterior surface opposite said inner surface and facing away from said armature;

a conductive blade coupled to movable contacts in said circuit breaker;

a load terminal having an end part that includes a terminal connector;

a bimetal attached at one end to said load terminal of said circuit breaker and at another end to at least a portion of said exterior surface such that said bimetal extends along the length of said exterior surface, said bimetal having a length that is longer than said magnetic yoke; and a flexible conductor attached to said conductive blade and to said bimetal, a portion of said flexible conductor passing along said inner surface opposite said bimetal.

14. The trip unit of claim 13, wherein said flexible conductor is attached to said bimetal by a weld, whereby electrical current will flow from said conductive blade directly to said bimetal via said flexible conductor.

15. The trip unit of claim 13, further comprising a second flexible conductor connected at one end to said bimetal proximate said load terminal and at an other end to said end part proximate said terminal connector, a portion of said second flexible conductor also passing through said channel of said magnetic yoke, said flexible conductors inducing a magnetic field relative to said yoke for causing mechanical displacement of an armature coupled to said yoke in response to electrical current passing through said flexible conductors.

16. The trip unit of claim 14, further comprising a second flexible conductor connected at one end to said bimetal proximate said load terminal and at an other end to said end part proximate said terminal connector, a portion of said second flexible conductor also passing through said channel of said magnetic yoke, said flexible conductors inducing a magnetic field relative to said yoke for causing mechanical displacement of an armature coupled to said yoke in response to electrical current passing through said flexible conductors.

17. The trip unit of claim 16, wherein said second flexible conductor is connected to said bimetal so as to form a loop before said second flexible conductor enters said yoke.

18. The trip unit of claim 16, wherein said yoke includes a retaining member for holding said flexible conductor and said second flexible conductor within said yoke.

19. The trip unit of claim 13 having an overall width no greater than one inch.

20. The trip unit of claim 13, wherein the length of said bimetal is greater than 1.5 inches and said width does not exceed one-quarter inch.

21. The trip unit of claim 13, wherein said shaped portion of said yoke is generally U-shaped.

* * * * *